US005088947A

United States Patent [19]

Whitley, II et al.

[11] Patent Number: 5,088,947

[45] Date of Patent: * Feb. 18, 1992

[54] FUEL TANK VENT

[75] Inventors: Warwick M. Whitley, II, Lynn Haven, Fla.; Clifton J. Ratza, Grand Rapids, Mich.

[73] Assignee: Attwood Corporation, Lowell, Mich.

[ * ] Notice: The portion of the term of this patent subsequent to Oct. 31, 2006 has been disclaimed.

[21] Appl. No.: 427,750

[22] Filed: Oct. 26, 1989

Related U.S. Application Data

[63] Continuation-in-part of Ser. No. 308,558, Feb. 2, 1989, Pat. No. 4,877,152.

[51] Int. Cl.[5] ..... B65D 25/02

[52] U.S. Cl. ..... 440/88; 137/588; 220/374; 220/DIG. 27

[58] Field of Search ..... 114/211; 440/88, 89; 137/587-589; 220/202, 254, 367, 372-374, 371, DIG. 27

[56] References Cited

U.S. PATENT DOCUMENTS

| | | | |
|---|---|---|---|
| 2,918,192 | 12/1959 | Dedman | 220/374 |
| 3,021,029 | 2/1962 | McKinlay | 220/363 |
| 3,866,789 | 2/1975 | Vambert | 220/373 |
| 3,916,724 | 11/1975 | Muller | 137/589 |
| 4,353,318 | 10/1982 | Williams | 440/88 |
| 4,706,840 | 11/1987 | Thompson | 220/373 |
| 4,825,905 | 5/1989 | Whitley | 440/88 |
| 4,877,152 | 10/1989 | Whitley | 440/88 |

*Primary Examiner*—Joseph F. Peters, Jr.
*Assistant Examiner*—Clifford T. Bartz
*Attorney, Agent, or Firm*—Price, Heneveld, Cooper, Dewitt & Litton

[57] ABSTRACT

A fuel tank vent for venting air and fumes from a fuel tank of a boat, said vent including an outer and inner restraining means for restraining the flow of water and other foreign materials from passing through said vent and contaminating the fuel in the tank. Each of said inner and outer restraining means includes a unique structure in and of itself and in combination for causing said water and foreign material to take a tortuous path and to be trapped prior to reaching the fuel tank.

13 Claims, 3 Drawing Sheets

Fig. 9
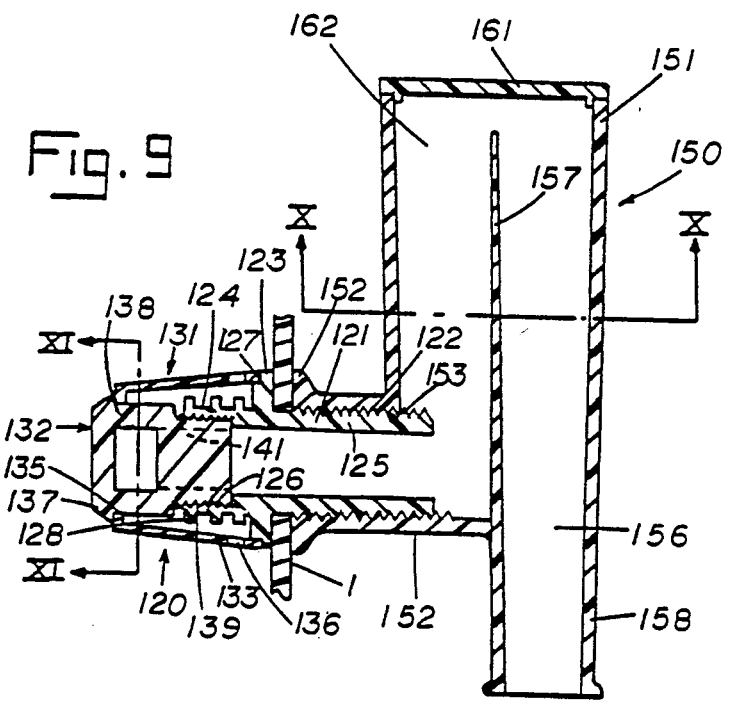
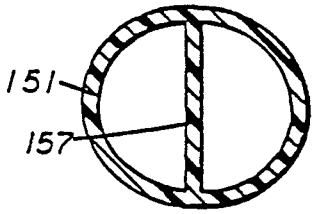
Fig. 10
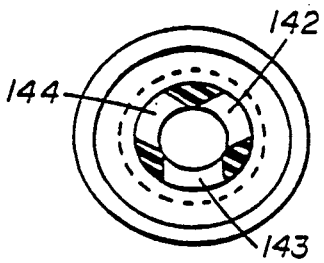
Fig. 11

FUEL TANK VENT

This application is a continuation-in-part application of United States application Ser. No. 07/308,558 filed Feb. 2, 1989; and entitled FUEL TANK VENT, now U.S. Pat. No. 4,877,152; issued on Oct. 31, 1989.

This invention relates to a fuel tank vent and particularly to such type of vent for fuel tanks on marine vessels in which the vent extends through the hull of a boat above the water line.

BACKGROUND OF THE INVENTION

Fuel tank vents are an absolute requirement for boats to allow air to escape as fuel is added to the tank and as the fuel is withdrawn while the engine is operating and to permit the fumes to escape from the tank. Such vents are located above the water line so as to prevent the water from flowing into the tank. However, because of the spray created by the boat as it passes through the water and because of waves splashing against the hull of the boat, it is necessary to prevent water from flowing through the fuel vent and thence to the hose connecting the vent to the tank. Water and other foreign material such as insects will contaminate the fuel in the tank and create damage to the boat's engine.

Since fuel vents are essential to the entire fuel system of the boat, extended efforts have been made to design and develop such vents which are splash resistant. To my knowledge no entirely satisfactory splash resistant vent has been designed.

The object of the present invention is to provide a fuel tank vent which is effective for venting the fuel tank of fumes and excess air as fuel is added to the tank. Such vent has a structure that effectively prevents water and other foreign materials, such as insects and the like, from passing through the vent and entering into the fuel tank.

SUMMARY OF THE INVENTION

The fuel tank vent of this invention provides a dual structure for restraining water and other foreign material from passing through the vent and into the fuel tank. The dual structure includes a restraining means located outside of the hull of the boat and communicating with a second restraining means located inside the hull. The outside restraining means includes an elongated member which extends through the wall of the hull of the boat and which includes a unique structure that provides a tortuous path for the flow of any water or other debris to pass therethrough.

The inner restraining means includes an elongated housing having an open lower end and a closed upper end forming a chamber communicating with the outer restraining means located outside of the hull. The housing is arranged at an angle to the elongated member of the inner restraining means. In one embodiment, a vent tube, open at both ends, extends into the chamber a distance just short of the closed upper end. This vent tube is of a smaller outer cross section than the inner cross section of the housing. The vent tube has an end extending out of the chamber and a flange for closing the open end of the housing so that any water or other foreign material has to pass into the space between the outer wall of the tube and the inner wall of the housing, then upwardly to the open top end of the tube and downwardly through said tube in order to enter into the hose and the fuel tank.

In a modified embodiment, the housing is an elongated member having a divider wall dividing the housing into two passageways or chambers. The divider wall extends upwardly in the housing to a point short of the upper wall so that air and vapors can pass from one chamber to another along a tortuous path and then through a passageway extending through the hull.

As previously stated, the structure of the vent located outside of the hull is unique in and of itself. It includes an elongated member extending through the hull of the boat with an inner end adapted to be located inside the hull and the outer end adapted to be located outside the hull and having an opening extending thereto providing communication between the inner and outer ends thereof. Means is provided for securing the elongated member to the hull in the opening. A cover assembly is provided secured to the elongated member and having a side wall extending from the top to the base thereof and spaced from the elongated member to form a passageway for the flow of air from the top of the cover to the base of the cover. This cover assembly has first and second vent openings. The first vent opening is located near the top of the cover assembly and the second vent opening is located in the side wall adjacent the base to provide communication through the passageway and the atmosphere outside the cover adjacent the base. Thus, the passage of air for communicating with the opening of the elongated member is confined through the passageway extending along the elongated member between the first vent opening and the second vent opening adjacent the base. Preferably radially extending spaced flanges are secured to the sides of the elongated member so as to provide an impediment against the flow of water or other foreign material through the passageway from the second vent opening to the first vent opening. In other words, the flow of any water or other foreign material is required to be along the axis and outside of the elongated member and the spaced radial flanges are located in this path to impede such flow.

Within a more specific preferred embodiment of this invention, the cover assembly is constructed of two pieces, a trim cover having a top with an opening therein which includes the wall extending from the top to the hull and a separate retainer member extending through the opening and securing the trim cover to the elongated member. This retainer member includes the first opening previously referred to.

The above objects, advantages and features of this invention will become more apparent from the following specification which describes the invention in conjunction with the drawings.

BRIEF DESCRIPTION OF THE DRAWINGS

FIG. 9 is a side, elevational, cross-sectional view of a modified design of this invention mounted on the hull of a boat;

FIG. 10 is a cross-sectional view taken along the plane X—X of FIG. 9; and

FIG. 11 is a cross-sectional view taken along the plane XI—XI of FIG. 9.

DESCRIPTION OF THE PREFERRED EMBODIMENT

Figure 1:
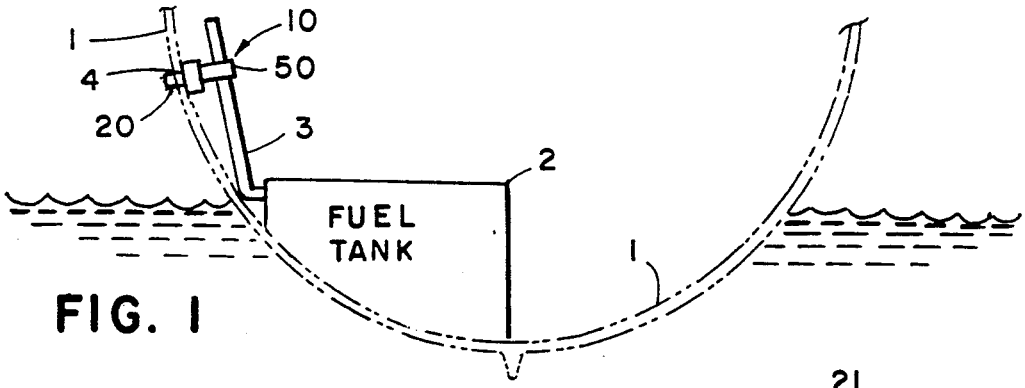
FIG. 1 is a partial, elevational, cross-sectional sketch of the hull of a boat illustrating the position of the fuel tank vent on the boat in relation to the hull and the fuel tank.

Referring now specifically to the drawings, FIG. 1 discloses the hull 1 of a boat with a fuel tank 2 mounted therein. The fuel tank vent 10 is disclosed mounted through the hull 1 of the boat and connected to a hose 3 leading to the fuel tank 2.

The gas tank vent includes the outer restraining means 20 and the inner restraining means 50 both provided to restrain the flow of water and other foreign material through the vent and into the hose 3 leading into the fuel tank 2.

Figure 5:
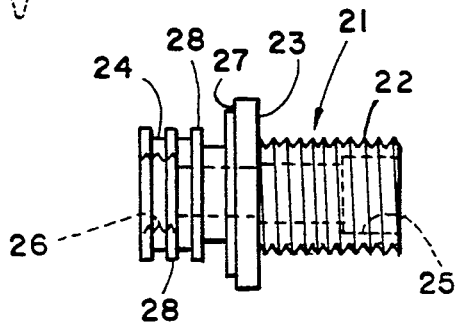
FIG. 5 is a side, elevational view of the vent body which is one component of the vent of this invention.
Figure 2:
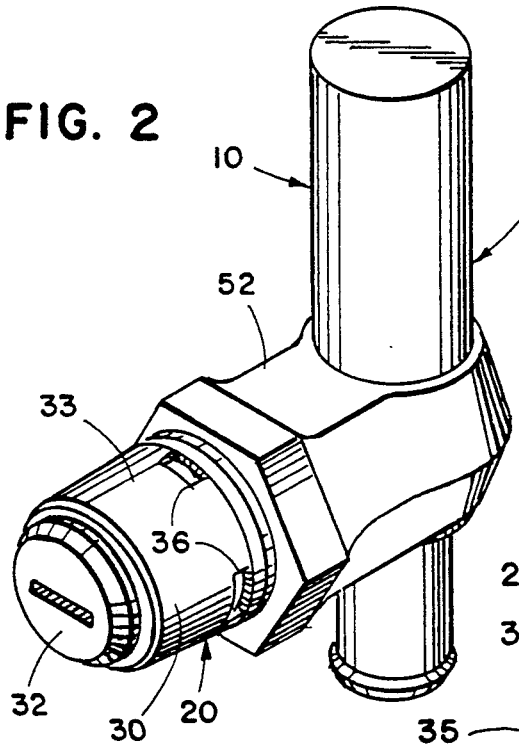
FIG. 2 is a front, elevational, perspective view of the fuel tank vent of this invention.
Figure 3:
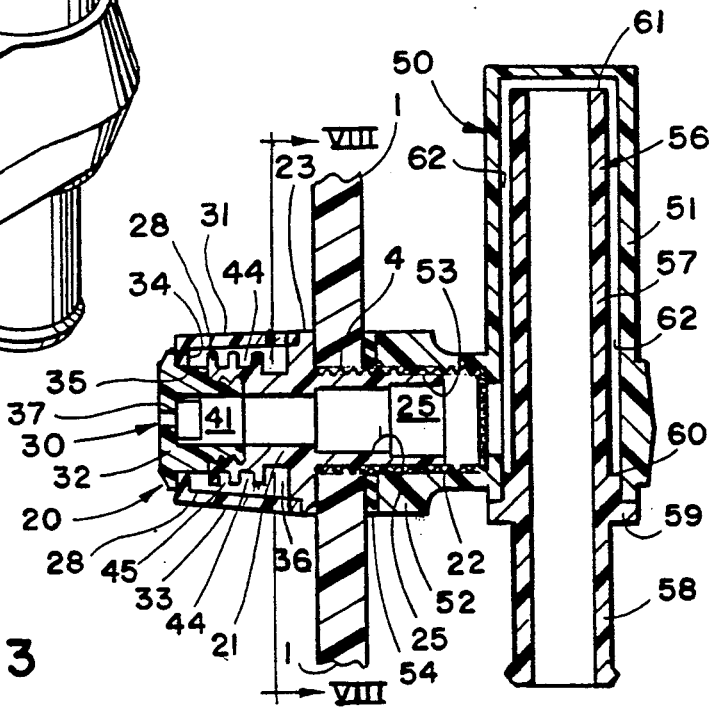
FIG. 3 is a cross-sectional, elevational view of the vent of this invention mounted on the hull of a boat
Figures 4, 6, 7, 8:
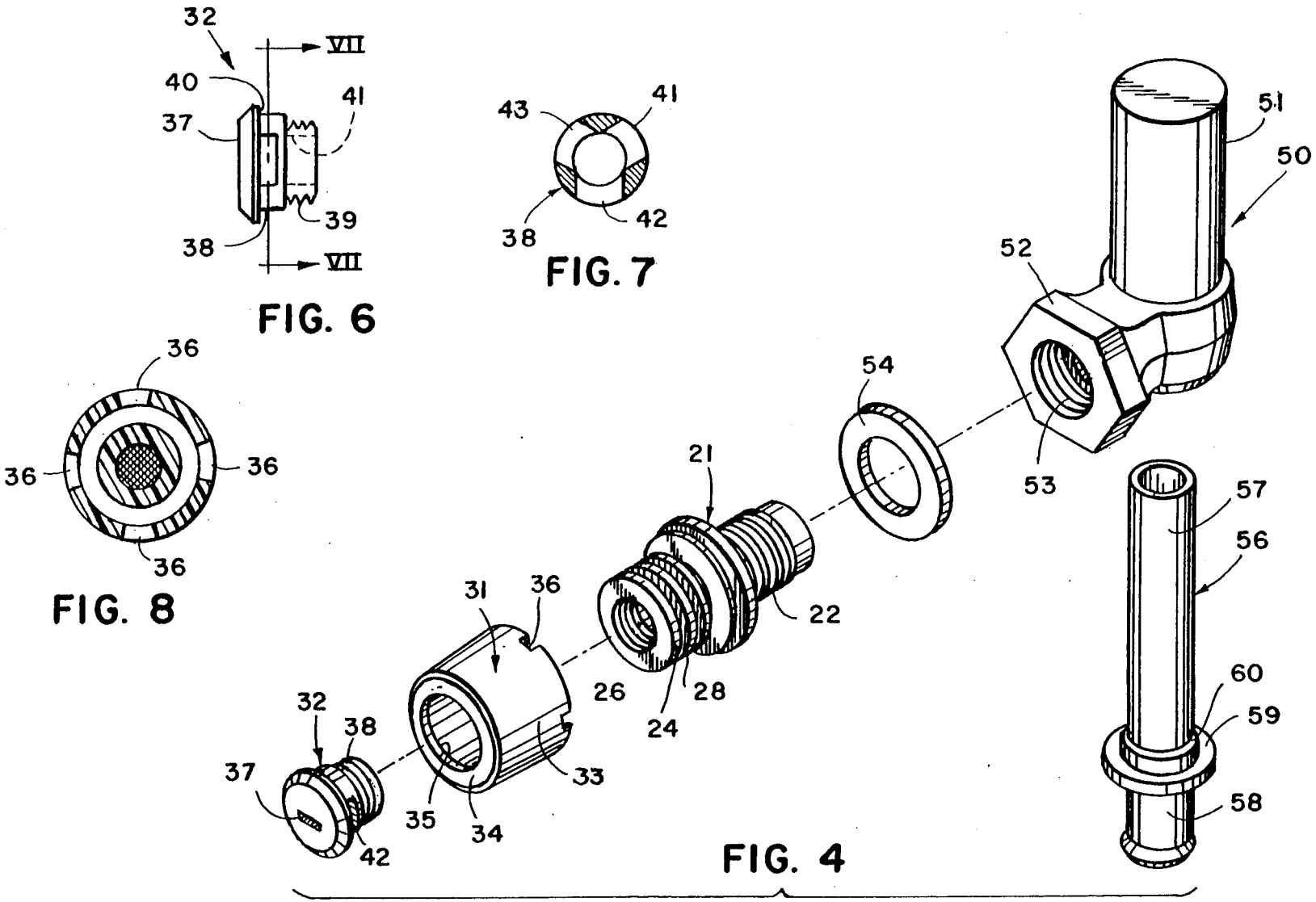
FIG. 4 is an exploded, perspective view disclosing the various parts of the vent of this invention.
FIG. 6 is a side, elevational view of the trim cover retainer which is another component of the vent of this invention.
FIG. 7 is a cross-sectional view taken along the plane VII—VII of FIG. 6.
FIG. 8 is a cross-sectional view taken along the plane VIII—VIII of FIG. 3.

The outer restraining means 20 includes the elongated vent body 21 (FIGS. 3, 4 and 5) extending through the opening 4 of the hull 1 (FIG. 3). The vent body 21 includes an inner threaded end 22 extending through the hull opening 4 and terminating at a shoulder of flange 23 that abuts against the outside of the hull 1. An outer end 24 extends outwardly from the flange 23. It includes a plurality of radial flanges 28 provided for the purpose of impeding the flow of water and other foreign material, as will be explained hereinafter. A passageway or opening 25 extends through the vent body 21 and the outer end 24 is threaded at 26 for the purpose of receiving a trim cover retainer 32 which will be described hereinafter.

The outer restraining means 20 also includes the trim cover assembly 30 comprising the trim cover 31 and the trim cover retainer 32. Trim cover 31 includes the side portions 33 and the top portion 34 which has a circular opening 35. The sides 33 from the top to the base are slanted outwardly to provide a truncated shaped cover. The base of the side portions fit into a circular recess 27. At this base, the trim cover 31 has a plurality of vent openings 36 provided for the purpose as will be set forth hereinafter.

The trim cover retainer (FIGS. 3, 6 and 7) includes a cover portion 37 of larger diameter than the opening 35. A cylindrical tube like protrusion 38 extends from cover portion 37. Protrusion 38 protrudes through the opening 35. Protruding from the protrusion 38 is the threaded end portion 39 which is threaded into the threads 26 of the vent body 21 so as to draw the shoulder 40 against the top portion 34 of the trim cover 31. As disclosed in FIG. 7, a central opening 41 extends through protrusions 38 and 39 and a major portion of the protrusion 38 includes the openings 42, 43 and 44 to provide a vent substantially around the entire circumference of the protrusion 38. As a result, substantially the entire passageway formed between the wall of the trim cover 31 and the elongated vent body 21 is in direct communication with the central opening 25 of the elongated vent body 21.

The inner restraining means 50 includes the vent tube housing 51 interconnected to the inner threaded end 22 of the elongated vent body 21 by the connector member 52 which includes the threaded bore 53 receiving the threads of the inner end 22 of vent body 21. The connector 52 is hexagonal in shape for the purpose of receiving a wrench for turning the entire inner restraining means 50 on the threads of the inner end 22. As disclosed, a rubber washer 54 is located between the hull 1 and the connecting member 52 for providing a tight seal.

It is important that the vent tube housing 51 has sufficient length as indicated to receive a vent tube 56 which has the two ends 57 and 58 with a flange 59 and collar 60 therebetween. As disclosed in FIG. 3, the collar 60 is of the same diameter as the inner diameter of the housing 51 and the flange 59 is of greater diameter so as to provide a shoulder which closes the lower end of housing 51 and locates or determines the position of the extreme end 61 of the vent tube 56. It will be noted that the vent tube 56 is of smaller outside diameter than the inside diameter of the vent tube housing 51. This provides a space 62 between the outer surface of the vent tube and the inner surface of the vent tube housing so that the air and fumes vented from the fuel tank pass upwardly into the vent tube around the top thereof and through the space 62 which is in communication with the bore 25 of the elongated vent body 21. Thus, inner restraining means 50 provides a tortuous path for any water or other foreign material passing through the inner restraining means.

MODIFICATION

FIGS. 9, 10 and 11 disclose a modification particularly in the inner restraining means 150. Restraining means 120 is substantially the same construction as the outer restraining means of FIGS. 1–8. It includes elongated vent body 121 having the inner threaded end 122 extending through the hull opening of the hull 1 and terminating at a shoulder or flange 123 that abuts against the outside of the hull 1. An outer end 124 having a plurality of radial flanges 128 extends outwardly from the flange 123. A passageway or opening 125 extends through the vent body 121 and the outer end 124 is threaded at 126 for the purpose of receiving the trim cover retainer 132.

A trim cover 131 is provided for the same purpose as the trim cover 31. It includes the side portions 133 slanted outwardly to provide a truncated shaped cover. The base of the sides 33 fit into a circular recess 127. The trim cover 131 has a plurality of vent openings 136 provided for the same purpose as the openings 36.

The trim cover retainer includes a cover portion 137 and a cylindrical tube like protrusion 138 which protrudes through the opening 135 of the cover 131. The protrusion 138 has a threaded end portion 139 which is threaded into the threads 126 so as to draw the cover portion 137 against the cover 131.

As disclosed in FIGS. 9 and 11, openings 142, 143 and 144 provide a vent substantially around the entire circumference of the protrusion 138 so as to provide direct communication with the central opening 125 and the passageway formed between the wall of the trim cover 131 and the vent body 121.

The inner restraining means 150 includes the cylindrical member of housing 151 divided into two chambers 156 and 162 by the divider wall 157. A tubular connector 158 extends from the lower end of the member or housing 151 for connection to the hose 3 leading into the fuel tank 2.

The housing or member 151 is interconnected to the inner threaded end 122 of the elongated bent body 121 by the connector member 152 which includes the threaded bore 153 receiving the threads of the inner end 122 of the vent body 121. The connector 152 is hexagonal in shape for the purpose of receiving a wrench for turning the entire restraining means 150 on the threads of the inner end 122. A rubber washer (not shown) may be located between the hull 1 and the connecting member 52 for providing a tight seal.

It is important that the divider wall 157 terminates short of the top plate 161 so that air and fumes vented from the fuel tank pass upwardly through the passageway 156 over the top of the divider wall 157 and through the passageway or chamber 162 which is in communication with the bore 125 of the elongated vent body 121. Thus, inner restraining means 151 provides a tortuous path for any water or other foreign material passing through the inner restraining means.

OPERATION

Having described the details of the various components of this fuel tank vent. The operation of the vent disclosed in FIGS. 1–8 should be quite evident. As previously stated, the air and fumes escape through the inside of the vent tube around the top 61, through the space 62 between the vent tube 56 and the vent tube housing 51, then through the passageway 25 of the vent body 21, central opening 41 of trim cover retainer, out of the openings 42, 43 and 44 of the trim cover retainer 32, through the passageway 45 formed between the wall 31 of the trim cover and the vent body 21 and then out of the openings 36 at the base of the trim cover.

By the same token, any water splashed against the outer restraining means 20 is required to pass through the openings 36 in the base of the trim cover 31, through the passageway 45, through the openings 42, 43 and 44 into the central opening 41. In passing through the passageway 45, the radial flanges 28 serve as an impediment to the flow of any moisture through the passageway 45. From the openings 42, 43, 44 and central opening 41, any moisture or other foreign material must then pass through the opening or passageway 25 of the vent body 21, through the screen 25, upwardly through the space 62 and around the top end 61 of the vent tube 57. Thus to reach the fuel tank hose 3 and the fuel tank, the water and other foreign material have to follow such a tortuous path that substantially no water, moisture or other foreign material reaches the fuel tank 2.

The operation of the vent disclosed in FIGS. 8–11 is quite similar to that previously disclosed in relation to the vent of FIGS. 1–8. The air escapes through the connector end 158 into the passageway or chamber 156 around the top of the divider wall 157, through the chamber or passageway 162, through the passageway 125 of the vent body 121, through central opening 141 of trim cover retainer 132, out of the openings 141, 143 and 144, through the passageway formed between the wall 131 of the trim cover and the vent body 121 and then out of the openings 136 at the base of the trim cover 131.

Any water splashed against the outer restraining means 120 is required to pass through the openings 136 in the base of the trim cover 131, through the passageway between the cover 131 and the vent body 121, through openings 142, 143 and 144 into the central opening 141. In passing through the passageway between the wall 131 of the trim cover and the vent body 121, the radial flanges 128 serve as an impediment to the flow of any moisture through the passageway between the wall 131 of the trim cover and the vent body 121. From the openings 142, 143, 144 and central 141, any moisture of other foreign material must then pass through the opening or passageway 125 of the vent body 121, upwardly through the space 162 and around the top end of the divider wall 157. Thus, to reach the fuel tank hose 3 and the fuel tank, the water and other foreign material have to follow such a tortuous path that substantially no water, moisture or other foreign materials reaches the fuel tank 2.

The structure of this vent makes for easy installation and for disassembling for clean out. Further, if the water should ever reach the spaces 62 or 162 only under extreme circumstances would the water accumulate to a height in space 62 or 162 that would cause the water to flow over the top end 61 of the vent tube or top end of divider wall 157. Instead, the water would flow downwardly through the same path from whence it came.

It should be understood that although I have disclosed a preferred embodiment of my invention, other embodiments and modifications can be made without departing from the spirit of this invention. Therefore, the scope of this invention should be interpreted only as set forth in the appended claims.

The embodiments of the invention in which an exclusive property or privilege is claimed is defined as follows.

1. In a fuel tank for a marine vessel in which a member is provided to extend through an opening in the hull of said vessel; said member having an inner end adapted to be located inside said hull and an outer end adapted to be located outside said hull and an opening extending therethrough providing communication between the inner and outer ends of said member with means for securing said member to said hull in said opening, the improvement comprising:

a housing adapted to be located inside said hull and having an open lower end and a closed upper end and a first chamber communicating with said opening in said member;

said housing being arranged at an angle to said member; and said housing having a second chamber open at both of its ends communicating with said first chamber at a position short of said closed upper end; means associated with said second chamber for connection to a hose leading to a fuel tank; and means at the lower end of said housing for providing said communication between said first chamber and said opening in said member whereby air and fumes vented from said tank are required to pass upwardly through said second chamber and then downwardly through said first chamber and into the opening of said member.

2. The fuel tank vent of claim 1 in which an attachment member extends from said housing orthogonal to the axis of said housing for securing said housing to said member; and an opening is provided extending through said attachment member providing communication between said opening in said member and the said first chamber inside of said housing.

3. The fuel tank vent of claim 1 in which said first and second chambers are formed by a divider wall extending from the lower end of said housing to a position short of the closed end of said housing.

4. The fuel vent of claim 3 in which the said housing is tubular and elongated and at its lower end has a tubular connector of lesser diameter than said housing for connection to a hose leading to a fuel tank, said tubular connection communicating with said second chamber.

5. A fuel vent of claim 4 in which the divider wall extends upwardly from and substantially tangent to the circumference of said tubular connector.

6. The fuel tank vent of claim 1 in which the said member provided for extending through said hull of said vessel is an elongated member;

a cover assembly having a top secured to said elongated member and having a side wall extending from said top to the base thereon and spaced from said elongated member to form a passageway for the flow of air from the said top to said base; said cover assembly having a first vent opening means inside the side walls near the top of said cover assembly to provide communication with the vent opening through said elongated member and said passageway; and a second vent opening means located in said side wall adjacent the base thereof to provide communication with said passageway and the atmosphere outside said cover only adjacent said base whereby the passage of air for communication with the said opening of said elongated member is confined through said passageway extending along said elongated member between said first vent opening near said top to said second vent opening adjacent said base.

7. The tank vent of claim 6 in which radially extending flange means is extended from the outer sides of said elongated member.

8. In a fuel tank for a marine vessel in which a member is provided to extend through an opening in the hull of said vessel; said member having an inner end adapted to be located inside said hull and an outer end adapted to be located outside said hull and an opening extending therethrough providing communication between the inner and outer ends of said member with means for securing said member to said hull in said opening, the improvement comprising:

a housing adapted to be located inside said hull and having an open lower end and a closed upper end, said housing having a divider wall forming a first chamber and a second chamber;

said housing being arranged at an angle to said member;

said first chamber communicating with said opening in said member;

said second chamber having means at its lower end for providing communication with said fuel tank; and said divider wall having means at its upper end for providing communication between said first and second chambers at the upper ends of said first and second chamber and said divider wall whereby air and fumes vented from said tank are required to pass upwardly through said second chamber and then downwardly through said first chamber and into the opening of said member.

9. The fuel tank vent of claim 8 in which an attachment member extends from said housing to said member; and an opening is provided extending through said attachment member providing communication between said opening in said member and the said first chamber inside of said housing.

10. The fuel vent of claim 9 in which said housing is tubular and elongated and at its lower end has a tubular connector of lesser diameter than said housing for connection to a hose leading to a fuel tank, said tubular connection communicating with said second chamber.

11. A fuel vent of claim 10 in which the divider wall extends upwardly from and substantially tangent to the circumference of said tubular connector.

12. The fuel vent of claim 8 in which the said member provided for extending through said hull of said vessel is an elongated member;

a cover assembly having a top secured to said elongated member and having a side wall extending from said top to the base thereon and spaced from said elongated member to form a passageway for the flow of air from the said top to said base; said cover assembly having a first vent opening means inside the side walls near the top of said cover assembly to provide communication with the vent opening through said elongated member and said passageway; and a second vent opening means located in said side wall adjacent the base thereof to provide communication with said passageway and the atmosphere outside said cover only adjacent said base whereby the passage of air for communication with the said opening of said elongated member is confined through said passageway extending along said elongated member between said first vent opening near said top to said second vent opening adjacent said base.

13. The tank vent of claim 12 in which radially extending flange means is extended from the outer sides of said elongated member.

* * * * *

UNITED STATES PATENT AND TRADEMARK OFFICE

CERTIFICATE OF CORRECTION

PATENT NO. : 5,088,947

DATED : February 18, 1992

INVENTOR(S) : Warwick M. Whitley, II et al.

It is certified that error appears in the above-identified patent and that said Letters Patent is hereby corrected as shown below:

Column 8, claim 9, line 15:
After "housing" insert --orthogonal to the axis of said housing for securing said housing--.

Signed and Sealed this

Seventeenth Day of August, 1993

Bruce Lehman

*Attest:*

BRUCE LEHMAN

*Attesting Officer*

*Commissioner of Patents and Trademarks*